US006061866A

United States Patent [19]

Friedheim

[11] Patent Number: 6,061,866

[45] Date of Patent: May 16, 2000

[54] CLEANING AND WASTE MANAGEMENT SYSTEM

[76] Inventor: Max Friedheim, 1165 Walnut Ave., Chula Vista, Calif. 91911

[21] Appl. No.: 09/133,163

[22] Filed: Aug. 12, 1998

Related U.S. Application Data

[60] Provisional application No. 60/055,716, Aug. 14, 1997.

[51] Int. Cl.[7] ..... A47L 5/38

[52] U.S. Cl. ..... 15/303; 34/222

[58] Field of Search ..... 34/218, 222; 15/301, 15/303, 314, 316.1

[56] References Cited

U.S. PATENT DOCUMENTS 4,363,674 12/1982 Fullenwider ..... 134/21
4,624,690 11/1986 Byrnes ..... 55/385 R
5,120,370 6/1992 Mori et al. ..... 134/22.15
5,896,674 4/1999 Kim et al. ..... 34/480

*Primary Examiner*—Henry Bennett
*Assistant Examiner*—Malik N. Drake
*Attorney, Agent, or Firm*—Evanns & Walsh; Joseph R. Evanns

[57] ABSTRACT

A cleaning and waste management system comprises a cleaning chamber substantially isolatable from the ambient and including at least one openable closure for accomplishing said isolation, the cleaning chamber for accommodating objects to be cleaned being connected to a collector for waste and contaminants from cleaning, and a cleaning member insertable into the chamber without substantially affecting the isolation of the interior of the cleaning chamber from the ambient. The cleaning member generates superheated vapor such as steam and to dispense such superheated vapor directed to an object to be cleaned so that the object may be hand-held in the cleaning chamber.

15 Claims, 2 Drawing Sheets

CLEANING AND WASTE MANAGEMENT SYSTEM

This application claims the benefit of U.S. Provisional Application No. 60/055,716 filed Aug. 14, 1997.

BACKGROUND OF THE INVENTION

1. Field of the Invention

The invention relates and pertains to cleaning and waste management systems particularly systems for operating at high speed, with high efficiency and with minimum use of liquid.

2. Description of the Prior Art

The demand for high efficiency, high speed cleaning and waste management systems has grown rapidly with the burgeoning of numerous fields technology. For example, in military applications rapid and efficient cleaning of weapons is often crucial. With respect to such applications as circuit boards, in regard to manufacturing and maintenance of such devices efficient and rapid cleaning is of substantial significance.

In addition, environmental requirements have been applied to cleaning operations and apparatus at all levels, for the purpose of not only eliminating contaminants from the environment but preventing contaminants from entering the environment as a result of cleaning operations of various objects. Awareness has grown that much of the problem of the bulk of residue/contaminants resulting from cleaning is attributable to the moisture/liquid employed in the cleaning process, the residue comprising contaminants and debris in solution and/or suspension. Attempts to address this problem by the use of solvents which vaporize to leave a compact residue have been largely unsuccessful due to certain undesirable properties (such as inflammability and toxicity) of such solvents.

The Mini-Max Cleaner® embodying the inventions of U.S. Pat. Nos. 4,414,037 and 5,471,556, invented by the inventor hereof, has proved to be reliable and effective in terms of rapid and efficient cleaning with minimal moisture/liquid content. The Mini-Max Cleaner®, which directs jets of super heated vapor (such as steam) of minimal moisture content to devices to be cleaned, causes bursts of debris to issue from the device to be cleaned, in connection with the cleaning process.

Accordingly, in view of recently environmental requirements, there has been a felt but thus far unfulfilled need for a rapid and efficient cleaning and waste management system with the capability of minimizing expulsion to the environment of contaminants cleaned from various objects that are cleared thereby.

SUMMARY OF THE INVENTION

A cleaning and waste management system includes a cleaning chamber substantially isolatable from the ambient and including at least one openable closure for accomplishing said isolation, said cleaning chamber being connected to collection means for collection of waste and contaminants from cleaning and accommodating objects to be cleaned and a cleaning member inserted from its exterior without substantially affecting the isolation of the interior of said cleaning chamber from the ambient. The collection means connected to said cleaning chamber provides convenient disposal of waste received therein.

A cleaning member is preferably such as to generate superheated vapor such as steam, and to dispense said superheated vapor directed to an object to be cleaned such that the object may be handheld as may be the cleaning member.

DETAILED DESCRIPTION OF THE INVENTION

Figure 1:
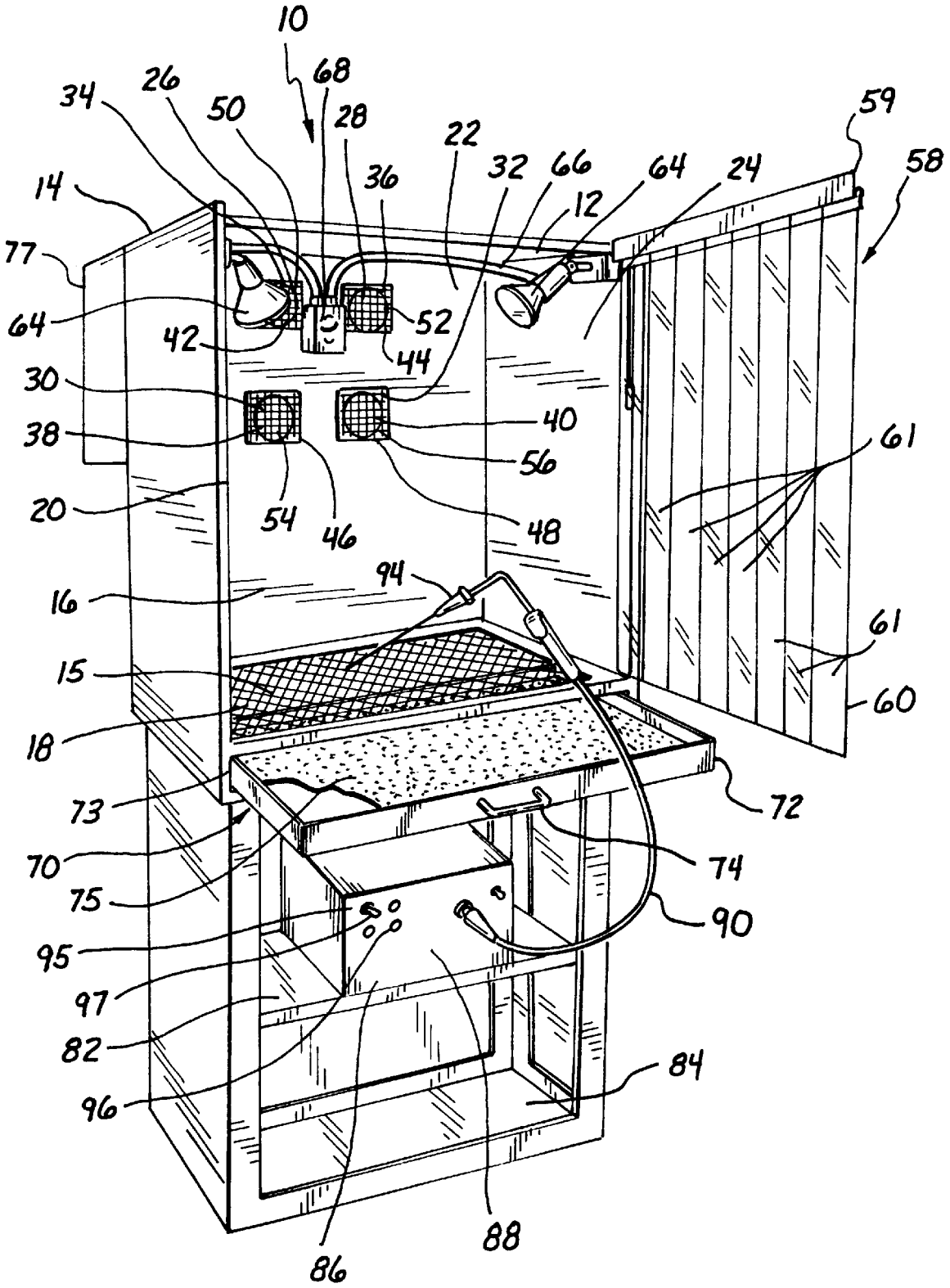
FIG. 1 is a perspective view of a cleaning and waste management system in accordance with the invention depicting the interior such that the device is in an open configuration.

As depicted in the drawings, a cleaning and waste management system 10 includes a cleaning chamber 12. Chamber 12 comprises a housing 14 defining an interior cleaning volume 16. The housing 14 may be constructed of steel, plastic, or any other durable material. It is not necessary for housing 14 to have any particular thermal properties when superheated vapor dispenser members are employed such that the stream of cleaning vapor is of short duration, superheated, relatively non-moist, and of short length.

At a bottom section 15 of housing 14 communicating with the interior cleaning volume 16 are a plurality of waste receiving slots 18. In the embodiment depicted, bottom 15 is formed of mesh which forms slots 18. Chamber 12 is defined by walls 20,22,24, together with bottom section 15.

Disposed at the upper portion of wall 22, are fans 26,28, 30,32. The specific number and positioning of the fans is flexible, and different numbers and positions may be employed in accordance with the invention.

Mounted in conjunction with fans 26,28,30,32 are filters 34,36,38,40, respectively. Filters 34–40 are of standard type and are provided for the purpose of aiding in collecting airborne contaminants expelled upon cleaning from the object to be cleaned. Filters 34–40 are positioned within fixtures 42,44,46,48, respectively which are mounted on wall 22 and include anterior grates 50, 52,54,56, respectively.

Cleaning chamber 12 includes an openable closure member 58. Member 58 as depicted comprises a frame 59 pivotably mounted on wall 24 with a curtain 60 suspended therefrom.

Curtain 60 comprises a plurality of hanging members or slats 61 overlapping one another, preferably of durable, non-reactive material such as plastic.

First collector means in the form of a sump 70 is connected to chamber 12 through slots 18. Sump 70 as depicted is in the form of a drawer 72 mounted in a base 73 below bottom 15 of chamber 12. A pull handle 74 is disposed at the front mid-point of drawer 72 to enable manipulation of drawer 72 inwardly and outwardly. Disposed on the interior surface of drawer 72 is a removable layer 75 of absorbent material such as cotton or forms of plastic for absorption and retention of contaminants received through slots 18.

Mounted on walls 20,24 of cleaning chamber 12 are lamps 64. The latter provide illumination of the interior of the cleaning chamber 12 when member 58 is in a closed position. Lamps 64 are connected to a wire 66 which is in turn connected to an on/off switch 68 for controlling the electrical power supply to cleaning chamber 12. Fans 26–32 are also coupled to this power supply.

As depicted, cleaning chamber 12 is mounted upon a stand having shelf surfaces 82, 84, which may be employed to hold various cleaning related equipment including a cleaning device 86 preferably comprising a Mini-Max Cleaner® device incorporating the inventions of U.S. Pat. Nos. 4,414,037 and 5,471,556 owned by the inventor hereof and incorporated by reference herein.

The cleaning member 86 comprises a housing 88 in which is disposed a generator (not shown) of superheated vapor such as steam. As fully described in the aforesaid prior patents, extending from housing 88 is a conduit 90 for carrying superheated vapor at the exterior end of conduit 90 is a handle 92 and outwardly of handle 92 is disposed a nozzle 94.

As fully disclosed in the aforesaid prior U.S. patents, the housing 88 contains a control panel 95 which mounts controls 96 including on/off switch 97 governing the operation of the cleaning member 86. Also as disclosed in the prior patents, handle 92 contains controls (not shown) for controlling dispensing of superheated vapor. Nozzle 94 is shown as dispensing a stream of superheated cleaning vapor.

Disposed rearwardly of rear wall 22 is second collection means in the form of a collection chamber 77 connected to vents (not shown) in rear wall 22 through which pass contaminants drawn out of chamber 12 by fans 26–32, inclusive. Chamber 77 is detachable from chamber 12 for the purpose of disposing of hazardous waste and includes a removable layer (not shown) of absorbent material for absorbing and retaining waste in the same manner as member 75 in drawer 72.

Figure 2:
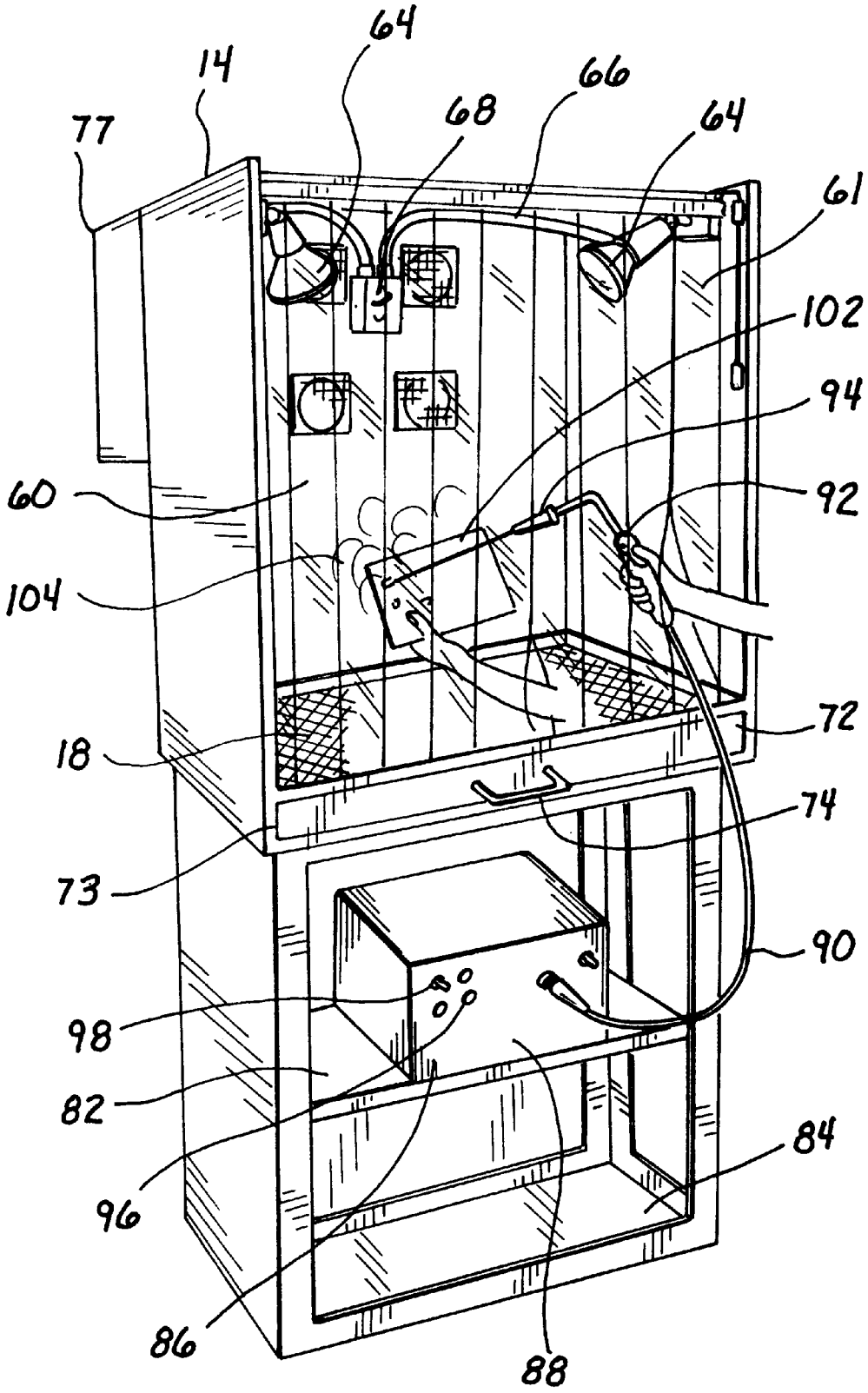
FIG. 2 is a perspective view of the cleaning system depicted in FIG. 1 in an operating configuration wherein a portion of the system is substantially isolated from the environment to prevent escape of contaminants thereinto.

In operation, system 10 is turned on by setting to their respective "on" positions switches 68, 97. This causes lamps 48 and fans 26–32 to commence operation and activates member 62. Closure member 58 is then moved to the closed position (FIG. 2). As fully disclosed in the aforesaid prior patents to the inventor thereof, such activation of member 62 causes generation of superheated vapor in member 86 dispensing through nozzle 94 of said superheated vapor being controlled by controls (not shown) on handle 68.

The operator (whose hands are shown schematically) then inserts an object 102 (shown schematically) to be cleaned into chamber 12 through curtain 60. Also inserted through curtain 60 into chamber 12 is nozzle 94 of cleaner 86; the nozzle 94 is directed toward object 102. Controls on handle 92 of cleaner 86 are then manipulated as described in the prior patents, producing a burst of non-moist superheated steam contacting object 102. As a result debris, waste and contaminants are rapidly removed from object 102 forming a cloud as burst of particles of debris 104. Some of the heavier particles and those removed near bottom section 15 pass into drawer 72 through slots 18. Particles remaining airborne are exhausted by fans 26–32 to collection chamber 77 which like drawer 72 is equipped with a layer of removable absorbent material (not shown) for absorption and retention of contaminants.

Because of the short-duration, short-length, jet of non-moist superheated vapor provided by cleaner member 86, the contaminated object 102 and member 86 may be hand-held by the operator without risk of injury to the operator.

The operator then removes object 102 and replaces it with another if desired. After cleaning is completed, collectors 72, 77 are purged by removal of their absorbent members which are then replaced for further use.

A specific embodiment of the invention is described and depicted hereinabove. The invention is defined by claims, to be submitted subsequently according to law, interpreted in light of the specification and drawings.

What is claimed is:

1. A cleaning and waste management system comprising:

(1) a cleaning chamber having an interior which is substantially isolatable from ambient and including at least one openable closure for accomplishing said substantial isolation and for accommodating a cleaning member and at least one object to be cleaned inserted from the exterior without substantially affecting the isolation of the interior of said cleaning chamber; and (2) a cleaning member insertable from the ambient into said cleaning chamber having the capability of providing a stream of superheated cleaning vapor at relatively high pressure.

2. The invention as set forth in claim 1 further including collection means connectable to said cleaning chamber for collection of waste and contaminants from cleaning.

3. The invention as set forth in claim 1 wherein said cleaning member comprises an outlet member connectable to a source of superheated vapor.

4. The invention as set forth in claim 3 wherein said cleaning member further includes means for providing a stream of superheated vapor of relatively short duration.

5. The invention as set forth in claim 3 wherein said cleaning member comprises means for providing a stream of superheated vapor of relatively short length.

6. A cleaning and waste management system comprising:

(1) a cleaning chamber having an interior which is substantially isolatable from ambient and including at least one openable closure for accomplishing said substantial isolation and for accommodating a cleaning member and at least one object to be cleaned inserted from the exterior without substantially affecting the isolation of the interior of said cleaning chamber; and (2) a cleaning member insertable from the ambient into said cleaning chamber having the capability of providing a stream of superheated cleaning vapor, said closure member comprising a plurality of slat members.

7. The invention as set forth in claim 1 wherein said pressure of said stream of superheated cleaning vapor is substantially at least 80 p.s.i.

8. A cleaning and waste management system comprising:

(1) a cleaning chamber having an interior which is substantially isolatable from ambient and including at least one openable closure for accomplishing said substantial isolation and for accommodating a cleaning member and at least one object to be cleaned inserted from the exterior without substantially affecting the isolation of the interior of said cleaning chamber; and (2) A cleaning member insertable from the ambient into said cleaning chamber having the capability of providing a stream of superheated cleaning vapor, said cleaning chamber including filter means for filtering waste and contaminants to substantially prevent same from entering the ambient.

9. A cleaning and waste management system comprising:

(1) a cleaning chamber having an interior which is substantially isolatable from ambient and including at least one openable closure for accomplishing said substantial isolation and for accommodating a cleaning member and at least one object to be cleaned inserted from the exterior without substantially affecting the isolation of the interior of said cleaning chamber; and (2) a cleaning member insertable from the ambient into said cleaning chamber having the capability of providing a stream of superheated cleaning vapor, said closure member comprising a plurality of slat members and said plurality of slat members being disposed substantially overlapping one another to form a substantial closure.

10. The invention as set forth in claim 5 wherein said waste collection means is connectable to a sump member for receiving waste and contaminants from cleaning conducted in said cleaning chamber.

11. A cleaning and waste management system comprising:

(1) a cleaning chamber having an interior which is substantially isolatable from ambient and including at least one openable closure for accomplishing said substantial isolation and for accommodating a cleaning member and at least one object to be cleaned inserted from the exterior without substantially affecting the isolation of the interior of said cleaning chamber; and (2) a cleaning member insertable from the ambient into said cleaning chamber having the capability of providing a stream of superheated cleaning vapor said cleaning member comprising an outlet member connectable to a source of superheated steam and comprising means for providing a stream of superheated vapor of relatively short length, and further comprising collection means connectable to said cleaning chamber for collection of waste and contaminants from cleaning, said collection means being connectable to a sump member for receiving waste and contaminants from cleaning conducted in said cleaning chamber, said sump member comprising a drawer member mounted below said cleaning chamber and moveable to receive waste and contaminants and to remove them upon collection therein.

12. The invention as set forth in claim 1 wherein said cleaning member includes control means for controlling the duration of superheated cleaning vapor emitted therefrom.

13. The invention as set forth in claim 1 wherein said cleaning member includes means for controlling the frequency of emission of superheated cleaning vapor therefrom.

14. The invention as set forth in claim 1 wherein said closure member is configured to afford access to the interior of said cleaning chamber by an object to be cleaned.

15. The invention as set forth in claim 14 wherein said access to the interior of said cleaning chamber is capable of accommodating a user's hand.

* * * * *